United States Patent [19]

Orlandi

[11] Patent Number: 4,898,286

[45] Date of Patent: Feb. 6, 1990

[54] STORAGE SYSTEM AND CONNECTOR FOR THE SAME

[76] Inventor: Arthur A. Orlandi, 507 Shady La., North Barrington, Ill. 60010

[21] Appl. No.: 158,301

[22] Filed: Feb. 19, 1988

[51] Int. Cl.[4] ..... A47F 43/00

[52] U.S. Cl. ..... 211/187; 211/191

[58] Field of Search ..... 211/187, 90, 189; 108/144, 111, 114, 109; 248/243

[56] References Cited

U.S. PATENT DOCUMENTS

| | | | |
|---|---|---|---|
| Re. 25,912 | 11/1965 | Kaufman et al. | 211/191 |
| 918,039 | 4/1909 | Grundmann | 211/187 X |
| 3,096,108 | 7/1963 | Baybarz | 211/191 X |
| 3,102,641 | 9/1963 | Konstant et al. | 211/191 |
| 3,174,592 | 3/1965 | Berman et al. | 211/187 X |
| 3,303,937 | 2/1965 | McConnell | 211/187 X |
| 3,342,347 | 9/1967 | Berend | 211/187 X |
| 3,351,212 | 11/1967 | McConnell | 211/187 X |
| 3,463,325 | 8/1969 | Lagotta et al. | 211/187 X |
| 3,465,895 | 9/1969 | Miller | 211/191 |
| 3,965,826 | 6/1976 | Markham | 211/187 X |

*Primary Examiner*—J. Franklin Foss

*Assistant Examiner*—Sarah A. Lechok

*Attorney, Agent, or Firm*—Clement and Ryan

[57] ABSTRACT

A storage system and a connector for use in the system. A shelf may be supported on a plurality of hangers or brackets, each of which has a horizontal shelf-supporting arm and a vertical arm. The hangers are connected to a plurality of upright posts, each of which posts defines at least one chevron-shaped or "Z"-shaped slot to receive a downwardly extending hook that is fixedly secured to the vertical arm of the hanger. Other shapes may be used for the hook-receiving slots, so long as one elongated arm of the slot slants upward and one downward, and the hook carried by the hanger slants downward in a direction 180° to the direction in which the upward elongated slot slants upward, while the lower elongated slot slants downward in a direction other than 180° to the direction the upper slot slants upward. An outwardly facing panel defining a plurality of hook-receiving two-armed slots, generally similar to a conventional peg board, may also be used. The hangers may include upwardly extending article-supporting hooks in place of horizontal shelf-supporting arms.

21 Claims, 1 Drawing Sheet

FIG. 1
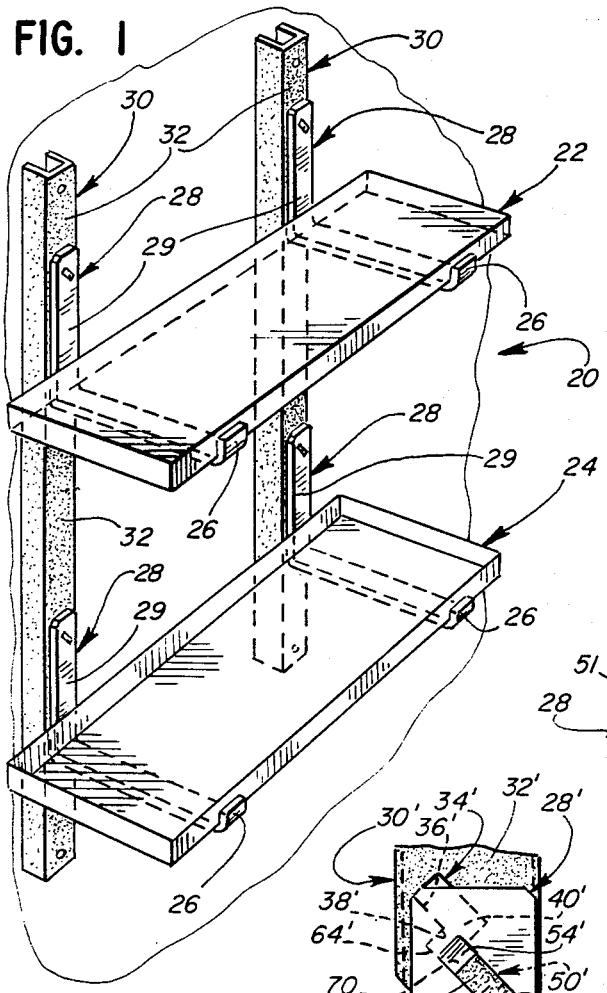
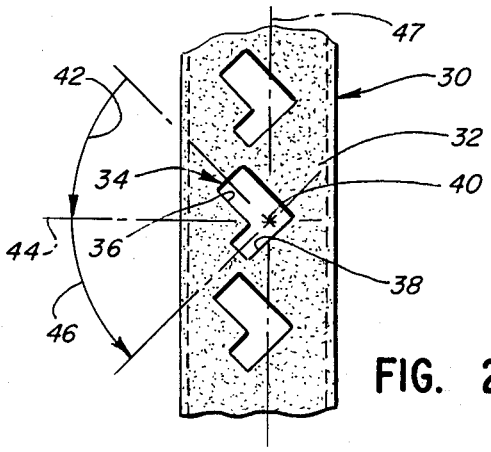
FIG. 2
FIG. 3
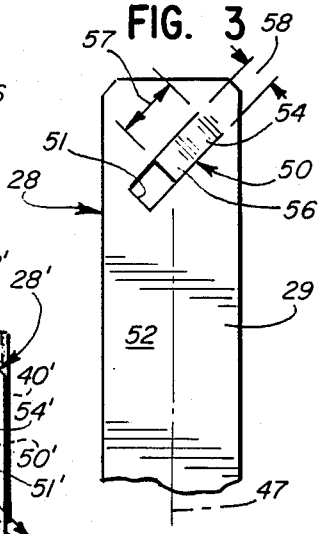
FIG. 4
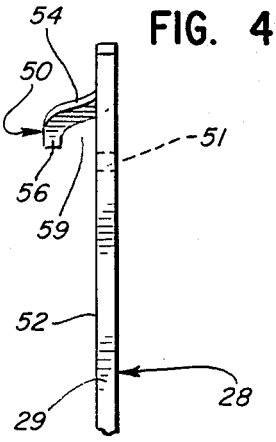
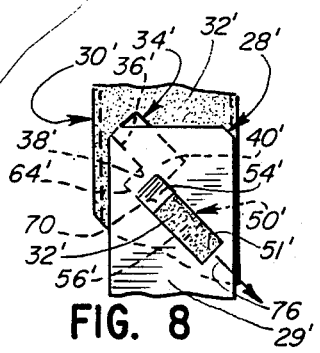
FIG. 8
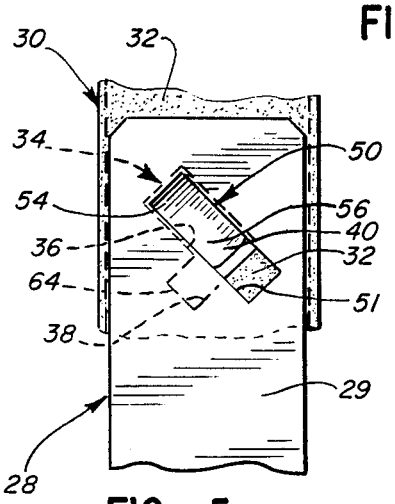
FIG. 5
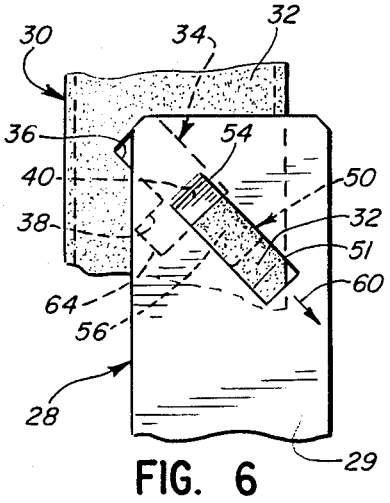
FIG. 6
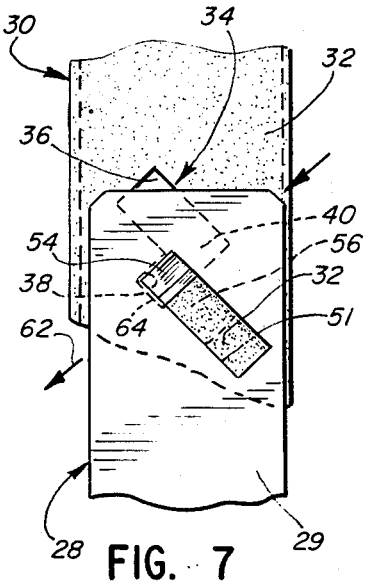
FIG. 7

STORAGE SYSTEM AND CONNECTOR FOR THE SAME

FIELD OF INVENTION

This invention relates to a knock-down storage system in which hangers or brackets for supporting shelves, or for carrying upwardly extending article-supporting hooks, are hooked securely onto upright posts or panels, without the necessity for any special clips, retainers, latches, bolts or other such fasteners, and are maintained in this assembled condition by gravity and by the weight of the articles stored. More particularly, it relates to such shelves or article-supporting hooks whose hangers or brackets can be disconnected from their associated upright posts or panels and moved from one vertical position to another while the shelves remain level, or the article-supporting hooks remain upright, throughout such repositioning.

BACKGROUND AND ADVANTAGES OF THE INVENTION

Knock-down shelving systems have been known for a great many years. Many of these, such as the systems disclosed in the patents to Flora et al. U.S. Pat. No. 2,596,332, Rasmussen U.S. Pat. No. 3,042,221, Miller U.S. Pat. No. 3,465,895, Jarvis U.S. Pat. No. 3,858,996, Bachand U.S. Pat. No. 4,161,303 and Ruschitzka U.S. Pat. No. 4,379,430, have required the use of special clips, retainers, latches, bolts or other such fasteners to hold the shelves in their erected condition. However, other shelving systems, some of which have been known for 50 years or more, have not required the use of such fasteners. Examples of these systems are those disclosed in the patents to Gibson et al. U.S. Pat. No. 1,984,473, Jackson et al. U.S. Pat. No. 2,266,206, Orlandi U.S. Pat. No. 3,850,396 and Markham U.S. Pat. No. 3,965,826.

Some prior art shelf hangers or brackets have reflected the desirability of maintaining the shelf in substantially the same orientation with respect to the horizontal while the shelf is being connected to, or disconnected from, the upright posts of the shelving system when the vertical positioning of the shelf is being adjusted. However, none of the prior art systems, so far as applicant is aware, have achieved this desirable feature as simply, and with the same degree of security, as does the present invention. As examples, both applicant's own U.S. Pat. No. 3,850,396 and Markham U.S. Pat. No. 3,965,826 involve more complicated structures than the present invention, and neither achieves the same security as this invention does.

SUMMARY OF THE INVENTION

The storage system of this invention may include a plurality of upright posts each of which has an outwardly facing, generally vertical, support wall. Each support wall defines at least one two-armed slot —usually a plurality of such slots in order to provide adjustability in positioning the one or more shelves of the system.

Each of the slots includes first and second elongated arms extending away from each other from a common junction. The first elongated arm extends upward from the junction of the two arms at a first predetermined acute angle to the horizontal, and the second arm extends downward from that junction at a second predetermined acute angle to the horizontal. The direction in which the second elongated slot arm extends downward is other than 180° to the direction in which the first elongated slot extends upward.

A hanger or bracket is associated with each upright post, at least two for each shelf of the system. Each hanger has a horizontal shelf-supporting arm and a vertical arm connected (as described below) to the post with which the hanger is associated.

A downwardly extending hook with a shank and a free end portion is fixedly secured to each hanger. The free end portion of the hook extends downward in a direction that is substantially 180° to the direction in which the first elongated slot arm in the upright post support wall extends upward.

In the assembled shelving system, the hook shank extends from in front of the upright post through the downwardly extending second elongated slot arm, adjacent the end of that slot arm that is remote from the slot junction. In this position, the hook free end portion extends transverse to the second elongated slot arm to a position behind the vertical support wall of the upright post.

It is preferred that the two elongated arms of each two-arm slot in the support wall of the upright post extend away from the slot junction on the same side of the vertical. The preferred angles at which these two elongated arms of the hook-receiving slot extend away from the slot junction are disclosed. With these preferred parameters, the hook-receiving slots are chevron-shaped.

A form is also disclosed for the hook-receiving slots that is "Z"-shaped, with a notch adjacent the end of the downwardly extending second slot arm that is remote from the slot junction.

If desired, the plurality of hook-receiving two-armed slots of this invention may be defined by an outwardly facing support panel that is generally similar to the conventional peg board. The hangers may, if desired, include upwardly extending article-supporting hooks in place of horizontal shelf-supporting arms.

If desired, the device of this invention may be used for relatively permanent storage of the articles in question. However, one of its most useful applications is as a point-of-purchase display rack for articles offered for sale in a retail establishment.

BRIEF DESCRIPTION OF THE DRAWING

The invention will now be described by reference to the accompanying drawing, in which:

FIG. 1 is a three-quarters perspective view of a shelving arrangement that is one embodiment of the storage system of this invention;

FIG. 2 is an enlarged, fragmentary, front elevation of an upright post of the shelving system of FIG. 1, showing several slots for receiving the hook of a shelf-supporting hanger;

FIG. 3 is a fragmentary rear elevation view of a shelf-supporting hanger for use in the shelving system of this invention, showing the downwardly extending hook by which the hanger is connected to an upright post;

FIG. 4 is a side elevation view of the hanger of FIG. 3, as viewed from the right-hand side of FIG. 3;

FIG. 5 is a fragmentary front elevation view of the hanger of FIG. 3 after it has been rotated 180° about the vertical, and its hook shank has been inserted into its initial inserted position in the upper elongated arm of one of the two-armed slots in the upright post shown in FIG. 2;

FIG. 6 is a fragmentary front elevation view of the same shelf-supporting hanger and upright post, after the hook shank of the hanger has been moved down to its intermediate inserted position at the junction between the two elongated arms of the two-armed slot in the upright post;

FIG. 7 is a fragmentary front elevation view of the same shelf-supporting hanger and upright post, after the hook shank of the hanger has been moved to its final inserted position adjacent the remote end of the downwardly extending elongated arm of the two-armed slot; and FIG. 8 is a fragmentary front elevation view of the shelf-supporting hanger and upright post of a second embodiment of this invention after the hook shank has been moved into its final inserted position adjacent the end of the second, downwardly extending elongated slot arm that is remote from the slot junction, which remote end includes a downwardly extending notch.

DETAILED DESCRIPTION OF TWO EMBODIMENTS OF THE INVENTION

FIG. 1 is a three-quarters perspective view of a simplified form of one embodiment 20 of the shelving system of this invention.

Shelves 22 and 24 are supported on horizontal arms 26 of hangers or brackets 28. Each hanger 28 has a vertical arm 29 that extends upward from shelf-supporting horizontal arm 26 and is connected (as described below) to one of the two upright posts 30.

Each post 30 has an outwardly facing, generally vertical, support wall 32. As shown in FIG. 2, which is a fragmentary front elevation of an upright post 30, each outwardly facing support wall 32 of an upright post 30 defines at least one two-armed slot 34. Each two-armed slot 34 includes a first elongated arm 36 and a second elongated arm 38, which extend away from each other from common junction 40.

In the embodiment disclosed in FIG. 2, first elongated slot arm 36 extends upward from junction 40 at first predetermined acute angle 42 to the horizontal 44. Second elongated slot arm 38 extends downward from junction 40 at second predetermined acute angle 46 to the horizontal 44. The direction in which second slot arm 38 extends downward is other than 180° to the direction in which first elongated slot arm 36 extends upward.

In the embodiment of FIG. 2, first elongated slot arm 36 in support wall 32 extends upward from slot junction 40 on the same side of the vertical 47 (i.e., on the left-hand side) as second elongated slot arm 38 extends downward from junction 40. In the embodiment shown, both angles 42 and 46 are 45°.

As seen in FIG. 1, each hanger 28 has a vertical arm 29 that in the assembled shelving is connected to upright post 30, in front of and in contact with outwardly facing support wall 32. In the embodiments shown in the drawing, both support wall 32 and hanger 28 are formed of sheet metal, and the contacting surfaces of the support wall and hanger are substantially coplanar.

FIG. 3 is a fragmentary rear elevation of vertical arm 29 of shelf-supporting hanger 28 showing downwardly extending hook 50 fixedly secured to hanger 28. In this embodiment hook 50 is integrally formed with hanger 28, having been punched out of the sheet metal of which the hanger is fabricated, to extend from rear face 52 of hanger 28 toward the viewer and out of the plane of the drawing. The punching out of hook 50 from vertical hanger arm 29 leaves opening 51 in arm 29.

FIG. 4 shows a side elevation view of hanger 28 and downwardly extending hook 50 as viewed from the right-hand side of FIG. 3. Each hook 50 has a shank 54 and a free end portion 56. Free end portion 56 is spaced, at 59, from rear surface 52 of vertical arm 29 of hanger 28. Space 59 is slightly deeper (from left to right in FIG. 4) than the thickness of support wall 32.

Length 57 and width 58 of hook 50 are such that the hook can be readily inserted through first elongated slot arm 36. For one thing (as will be seen from FIG. 5), over-all length 57 of hook 50, including shank 54 and free end portion 56, is less than the length of first elongated slot arm 36, including slot junction 40. Second, width 58 of the hook is slightly less than the width of slot arm 36.

In FIG. 5, hanger 26 has been rotated 180°, about the vertical 47, from its position in FIG. 3. This has brought free end portion 56 of hook 50 to a position in which it extends downward in a direction that is substantially 180° to the direction in which first elongated slot arm 36 in support wall 32 of upright post 30 extends in the upward direction away from slot junction 40.

In the condition shown in FIG. 5, shank 54 of hook 50 and free end portion 56 extending therefrom have been inserted in first elongated slot arm 36 from in front of outwardly facing support wall 32 of post 30, to position vertical arm 29 of hanger 28 in front of wall 32, with rear surface 52 of vertical arm 29 in contact with support wall 32. The position of hook 50 just described is the initial inserted position of the hook, located at the end of first elongated slot arm 36 that is remote from junction 40. In this position, free end portion 56 of hook 50 is positioned adjacent slot junction 40. A portion of support wall 32 of upright post 30 can be seen in FIG. 5 through opening 51 in hanger arm 29.

In the view shown in FIG. 6, vertical arm 29 of hanger 28 has been moved in direction 60 to the right and downward from the position shown in FIG. 5, to bring hook shank 54 to its intermediate inserted position at slot junction 40. In this position, free end portion 56 of hook 50 extends, on the far side of support wall 32 of upright post 30, to a position that is beyond slot junction 40 and behind wall 32. Support wall 32 of post 30 is again seen through opening 51 in hanger arm 29.

In FIG. 7, vertical wall 29 of hanger 28 has been moved in direction 62 downward and to the left from the position shown in FIG. 6, to move hook shank 54 from its intermediate inserted position to its final inserted position adjacent end 64 of second elongated slot arm 38 that is remote from slot junction 40. In this final inserted position, free hook end portion 56 extends transverse to the longitudinal axis of second slot arm 38 to a position behind generally vertical support wall 32 of upright post 30, which wall is seen through opening 51 in hanger arm 29.

As will be seen, both pairs of hangers 28 and shelves 22 and 24 supported thereby that are shown in FIG. 1 can be maintained in substantially the same orientation with respect to the horizontal while they are being connected to upright posts 30 in the manner just described. In addition, they can be maintained in substantially the same orientation with respect to the horizontal while they are being disconnected from the upright posts. Shelves 22 and 24 thus remain in the same orientation with respect to the horizontal whether they are being connected to, or disconnected from, or supported in fixed positions on, the upright posts.

The reason the hangers and the shelves supported by them can be thus maintained in substantially the same orientation with respect to the horizontal is because, as already explained above, the free end portion of the downwardly extending hook carried by each shelf-supporting hanger extends in a direction that is 180° to the direction that the first elongated slot in the two-armed slot on the vertical support wall of the upright post extends upward. This fact means, as will be seen, that a properly dimensioned hook can be readily inserted in the first elongated slot arm while the vertical arm of the shelf-supporting hanger remains oriented exactly vertically.

A further advantage to the shelf connector is the security of the attachment of the shelves to upright posts 30 that is provided by this connector. As will be seen by reversing the steps described with respect to FIGS. 5–7, two definite movements of hook 50 with respect to its associated upright post 30 are required before the hook can be removed from two-armed slot 34.

Before vertical arm 29 of hanger 28 can be moved outward from the plane of the drawing to remove hook 50 from its engagement with upright post 30 as shown in FIG. 7, vertical arm 29 of hanger 28 must first be moved upward and to the right in the direction opposite to direction 62 in that Figure (i.e., to the intermediate inserted position of hook shank 54), and then must be moved upward and to the left in the direction opposite to direction 60 in FIG. 6 (i.e., to the initial inserted position of hook shank 54).

This double movement of hanger 28 before it can be separated from upright post 30 provides a very safe and secure connection of each shelf 22 and 24 to the upright posts, which guards against any accidental dislodgement of a shelf from its upright posts.

As will be seen from FIG. 6, the reason the hook carried by the shelf-supporting hanger must be thus moved to the initial inserted position of the hook shank before the hook can be removed from the hook-receiving slot in the upright post is that the hook free end portion extends behind the support wall when the hook is in the intermediate inserted position. This in turn is because the second elongated slot arm extends downward from the slot junction in a direction other than 180° to the direction in which the first elongated slot arm extends upward, which means that the second elongated slot arm and the hook free end portion extend downward in different directions from each other.

It will be seen that in the embodiment of FIGS. 2–7 two-armed slots 34 have a chevron shape. Still greater security can be provided, if desired, by adding notch 70 adjacent end 64' of elongated slot arm 38' that is remote from slot junction 40'. Notch 70 extends in a direction different from the direction in which second elongated slot arm extends from slot junction 40'. In the embodiment shown in FIG. 8, notch 70 extends downward at approximately 45° to the horizontal, on the opposite side of the vertical from the side on which second elongated slot arm 38' extends downward from junction 40'. Hook shank 54' rests in notch 70, with hook free end portion 56' again extending to a position behind vertical support wall 32' of upright post 30'.

As shown in FIG. 8, slot 34' in support wall 32' is generally "Z"-shaped in form. As will be seen, this construction requires one additional movement, in direction 76, to seat hook shank 54' in its final position. By the same token, one additional movement, in the direction opposite to direction 76, is required to disengage hook 50' from upright post 30', which makes for still greater security against accidental dislodgement of the hook from its upright post.

As already indicated above, the outwardly facing, generally vertical, support wall by which the two-armed hook-receiving slots are defined may comprise, if desired, a single panel rather than the front walls of a plurality of upright posts. Such a single panel support wall may be, for example, a panel generally similar to a conventional peg board.

Another variation, whether upright posts or a single support panel are used, is to employ hangers carrying outwardly and upwardly extending article-supporting hooks rather than horizontal shelf-supporting arms.

The posts, support panels, hangers, and shelves utilized in the storage system of this invention may be fabricated of any material suitable for the construction of the particular member in question. Thus, depending upon which member is involved, the material used may be metal, wood, hardboard, particle board, plastic, or any other suitable material.

The downwardly extending hanger-supporting hooks of this storage system may be made with any suitable cross-sectional shape. If desired they may, for example, be of wire construction, circular in cross section, and welded to the vertical arm of the hanger.

The above detailed description has been given for ease of understanding only. No unnecessary limitations should be understood therefrom, as modifications will be obvious to one skilled in the art.

I claim:

1. In a system for storing various articles, a connector for supporting a shelf, or an upwardly extending article-supporting hook, in an elevated position, which connector comprises:

(a) an outwardly facing, generally vertical, support wall, said outwardly facing support wall defining a two-armed slot, said slot including first and second elongated arms extending away from each other from a common junction, said first elongated arm extending upward from said junction at a first predetermined acute angle to the horizontal, said second elongated slot arm extending downward from said junction at a second predetermined acute angle to the horizontal, the direction in which said second slot arm extends downward being a direction other than 180° to the direction in which said first elongated slot extends upward;

(b) a hanger having (i) a vertical arm connected to said outwardly facing support wall in the manner hereinafter described; and (ii) an outwardly extending member providing support for said articles to be stored, said hanger being positioned in front of and in contact with said support wall; and (c) a downwardly extending hanger-supporting hook fixedly secured to said hanger, said hook having a generally horizontal shank and a free end portion, said hook free end portion extending downward from said shank in a direction that is substantially 180° to the direction in which said first elongated slot arm in said outwardly facing support wall extends upward, said hook free end portion being insertable in said first elongated slot arm, said hook shank extending from in front of said support wall, adjacent the end of said downwardly extending second slot arm that is remote from said slot junction, through said second elongated slot arm, said hook free end portion extending transverse to said second elongated slot arm to a position behind said support wall.

2. The shelf connector of claim 1 in which said first elongated arm of said two-armed slot in said outwardly facing support wall extends upward from said slot junction on the same side of the vertical as said second elongated slot arm extends downward from said junction.

3. The shelf connector of claim 2 in which said first predetermined angle is about 45°.

4. The shelf connector of claim 3 in which said second predetermined angle is about 45°.

5. The shelf connector of claim 1 in which:

(a) said downwardly extending second elongated slot arm in said outwardly facing support wall includes a notch adjacent said remote end of said second slot arm, (b) said notch extends downward in a direction different from the direction in which said second slot arm extends downward from said slot junction, and (c) the shank of said hanger-supporting hook rests in said notch.

6. The shelf connector of claim 5 in which:

(a) said first predetermined angle is about 45°, (b) said second predetermined angle is about 45°, (c) said first elongated arm of said two-armed slot in said outwardly facing support wall extends upward from said slot junction on the same side of the vertical as said second elongated slot arm extends downward from said junction, and (d) said notch extends downward at approximately 45° to the horizontal, on the opposite side of the vertical from the side on which said second elongated slot arm extends downward from said slot junction.

7. The shelf connector of claim 1 in which said outwardly facing support wall and said hanger are formed of sheet metal, and the contacting surfaces of said support wall and hanger are substantially coplanar.

8. A method of supporting articles on a shelf or on an upwardly extending article-supporting hook in an elevated, fixed position on at least one outwardly facing, generally vertical, support wall, which comprises:

(a) providing at least one two-armed slot in each of said at least one outwardly facing, generally vertical, support wall, each of said slots including first and second elongated arms extending away from each other from a common junction, said first elongated arm extending upward from said junction at a first predetermined acute angle to the horizontal, said second elongated arm extending downward from said junction at a second predetermined acute angle to the horizontal, the direction in which said second slot arm extends downward being a direction other than 180° to the direction in which said first elongated slot arm extends upward;

(b) providing at least one hanger for each of said at least one outwardly facing support wall, said hanger having (i) a vertical arm for connection to said support wall, and (ii) an outwardly extending member for supporting said articles to be stored, said hanger being adapted to be positioned in front of, with the rear surface of said vertical arm in contact with, said at least one outwardly facing support wall, said hanger carrying a downwardly extending hanger-supporting hook fixedly secured thereto, said hook having a shank extending outward from the rear surface of the vertical arm of said hanger and a free end portion, said hook free end portion being spaced from said hanger rear surface, (c) inserting each of said hook free end portions from in front of said at least one outwardly facing support wall through said first elongated arm of said two-armed slot to bring said hook to an initial inserted position in which said hook shank is positioned at the end of said first elongated slot arm that is remote from said slot junction, and said hook free end portion is positioned adjacent said junction, (d) moving said hook shank from said initial, inserted position to an intermediate inserted position at said slot junction, in which intermediate position said hook free end extends beyond said junction to a position behind said at least one outwardly facing support wall; and (e) thereafter moving said hook shank from said intermediate inserted position at said slot junction to a final inserted position adjacent the end of said second elongated slot arm that is remote from said slot junction, in which final position said free hook end portion extends transverse to the longitudinal axis of said second slot arm to a position behind said at least one outwardly facing support wall;

whereby said hangers and said shelf supported thereby, or said upwardly extending article-supporting hook carried thereby, can be maintained in substantially the same orientation with respect to the horizontal while said hangers are being connected to, or disconnected from, said at least one outwardly facing support wall, as well as when they are in said fixed position supported on said wall.

9. The method of claim 8 in which said first elongated arm of said two-armed slot in each of said at least one outwardly facing support wall extends upward from said slot junction on the same side of the vertical as said second elongated arm extends downward from said junction.

10. The method of claim 9 in which said first predetermined angle to the horizontal at which said first elongated slot arm extends upward from said slot junction is about 45°.

11. The method of claim 10 in which said second predetermined angle to the horizontal at which said second elongated slot arm extends downward from said slot junction is about 45°.

12. The method of claim 8 in which:

(a) said downwardly extending second elongated slot arm in said at least one outwardly facing support wall includes a notch adjacent said remote end of said second slot arm, (b) said notch extends downward in a direction different from the direction in which said second slot arm extends downward from said slot junction, and (c) when the shank of said hanger-supporting hook is moved to its said final inserted position it rests within said notch.

13. The method of claim 12 in which:

(a) said first predetermined angle is about 45°, (b) said second predetermined angle is about 45°, (c) said first elongated arm of said two-armed slot in said at least one outwardly facing support wall extends upward from said slot junction on the same side of the vertical as said second elongated slot arm extends downward from said junction, and (d) said notch adjacent said remote end of said second elongated slot arm in said at least one outwardly facing support wall extends downward at approximately 45° to the horizontal, on the opposite side of the vertical from the side on which said second elongated slot arm extends downward from said slot junction.

14. The method of claim 8 in which said at least one outwardly facing support wall and said hanger are formed of sheet metal, and the contacting surfaces of said support wall and hanger are substantially coplanar.

15. A system for storing various articles including at least one shelf, or at least one upwardly extending article-supporting hook, located at a given elevation, which system comprises:

(a) at least one outwardly facing, generally vertical, support wall, each of said support walls defining at least one two-armed slot, each of said slots including first and second elongated arms extending away from each other from a common junction, said first elongated arm extending upward from said junction at a first predetermined acute angle to the horizontal, said second elongated slot arm extending downward from said junction at a second predetermined acute angle to the horizontal, the direction in which said second slot arm extends downward being a direction other than 180° to the direction in which said first elongated slot arm extends upward;

(b) a hanger associated with each of said at least one two-armed slot, each of said hangers having (i) a vertical arm for connection to said at least one outwardly facing support wall, and (ii) an outwardly extending member providing support for said articles to be stored at said given elevation;

(c) a downwardly extending hanger-supporting hook fixedly secured to each of said hangers, each of said hooks having a generally horizontal shank and a free end portion, said hook free end extending downward from said shank in a direction that is substantially 180° to the direction in which said first elongated slot arm in said at least one outwardly facing support wall extends upward, said hook free end portion being insertable in said first elongated slot arm, said hook shank extending from in front of said support wall, adjacent the end of said downwardly extending second elongated slot arm that is remote from said slot junction, through said second elongated slot arm, said hook free end portion extending transverse to said second elongated slot arm to a position behind said support wall; and (d) a shelf supported by said plurality of hangers.

16. The storage system of claim 15 in which said first elongated arm of said two-armed slot in each of said at least one outwardly facing support wall extends upward from said slot junction on the same side of the vertical as said second elongated slot arm extends downward from said junction.

17. The storage system of claim 16 in which said first predetermined angle to the horizontal at which said first elongated slot arm extends upward from said slot junction is about 45°.

18. The storage system of claim 17 in which said second predetermined angle to the horizontal at which said second elongated slot arm extends downward from said slot junction is about 45°.

19. The storage system of claim 18 in which:

(a) said downwardly extending second elongated slot arm in each of said at least one outwardly facing support wall includes a notch adjacent said remote end of said second slot arm, (b) said notch extends downward in a direction different from the direction in which said second slot arm extends downward from said slot junction, and (c) each of said hook shanks rests in said notch in its associated downwardly extending second elongated slot arm.

20. The storage system of claim 19 in which:

(a) said first predetermined angle is about 45°, (b) said second predetermined angle is about 45°, (c) said first elongated arm of said two-armed slot in said at least one outwardly facing support wall extends upward from said slot junction on the same side of the vertical as said second elongated slot arm extends downward from said junction, and (d) each of said notches extends downward at approximately 45° to the horizontal, on the opposite side of the vertical from the side on which said second elongated slot arm extends downward from said slot junction.

21. The storage system of claim 15 in which each of said at least one outwardly facing support wall and each of said hangers is formed of sheet metal, and the contacting surfaces of said support wall and said hanger are substantially coplanar.

* * * * *